United States Patent [19]

Bergmann et al.

[11] 4,024,747

[45] May 24, 1977

[54] APPARATUS FOR CONVEYING PUNCHED-OUT COMPONENTS

[75] Inventors: Ewald Bergmann, Rechberghausen; Horst Pfisterer, Goppingen, both of Germany

[73] Assignee: L. Schuler GmbH, Germany

[22] Filed: Aug. 5, 1976

[21] Appl. No.: 711,974

[30] Foreign Application Priority Data

Aug. 28, 1975 Germany ..... 2538239

[52] U.S. Cl. ..... 72/325; 113/116 V; 113/116 Y; 206/820

[51] Int. Cl.² ..... B21D 31/02

[58] Field of Search ..... 72/325, 328, 338, 421, 72/425, 426, 427, 324; 113/113 R, 113 B, 113 C, 116 V, 116 Y, 116 CC, 116 BB, 1 F; 214/1 F, 311; 198/483, 484, 655, 656; 206/330, 329, 328, 820

[56] References Cited

UNITED STATES PATENTS

| | | | |
|---|---|---|---|
| 3,380,282 | 4/1968 | Scaletta et al. | 113/113 R X |
| 3,472,365 | 10/1969 | Tiedema | 206/820 X |
| 3,651,774 | 3/1972 | Gilev et al. | 113/113 R |

*Primary Examiner*—James R. Duzan
*Attorney, Agent, or Firm*—Craig & Antonelli

[57] ABSTRACT

Apparatus for the conveyance of components punched out from a strip of material with the formation of a punched grid out of the working area of a press includes a feeding mechanism for conveying the strip of material into the working area of the press. At least one controllable ejector is arranged in an upper die for ejecting the punched-out components during the return stroke of the upper die onto the strip of material itself which is the conveyor. Lugs are punched into a remaining portion of the strip of material to be processed, behind the punched-out component, these lugs serving to retain the punched-out and dropped-off components on the strip of material.

9 Claims, 3 Drawing Figures

APPARATUS FOR CONVEYING PUNCHED-OUT COMPONENTS

FIELD OF THE INVENTION

This invention relates to an apparatus for the conveyance of components punched out from a strip of material with the formation of a punched grid out of the working area of a press.

DESCRIPTION OF THE PRIOR ART

German Published Application No. 2,360,998 discloses an apparatus for removing sheet-material parts produced from band or strip-shaped material from presses wherein a conveyor belt with vacant zones is provided as the transporting means. The top of the conveyor belt is guided over fixed drive and guide rollers above the working surface. The conveyor belt conveys the sheet-metal components thus manufactured, which are dropped by the ram and/or by the upper die, at right angles to the conveying direction of the band - and/or strip-shaped material out of working area of the press. The conveyor belt is controlled in dependence on the ram position, so that when the conveyor belt is at a standstill the upper die can extend through a vacant zone. The stroke rates of the presses equipped with such conveyor belts are limited due to the inherent mass at the high accelerations which occur.

SUMMARY OF THE INVENTION

This invention is based on the objective of providing an apparatus for the conveying of punched-out components, permitting the operation of a press with very high stroke rates.

The advantages of the invention are to be seen particularly in that it is necessary to provide a conveyor belt with the drive mechanisms pertaining thereto. This eliminates many wearprone mechanical parts. Furthermore, it is possible to operate a press featuring the apparatus of this invention at a very high stroke rate, because inter alia of the minor stroke. Existing presses can be equipped with the apparatus of this invention in a simple operation without having to execute extensive structural alterations on the press.

DETAILED DESCRIPTION

Figure 1:
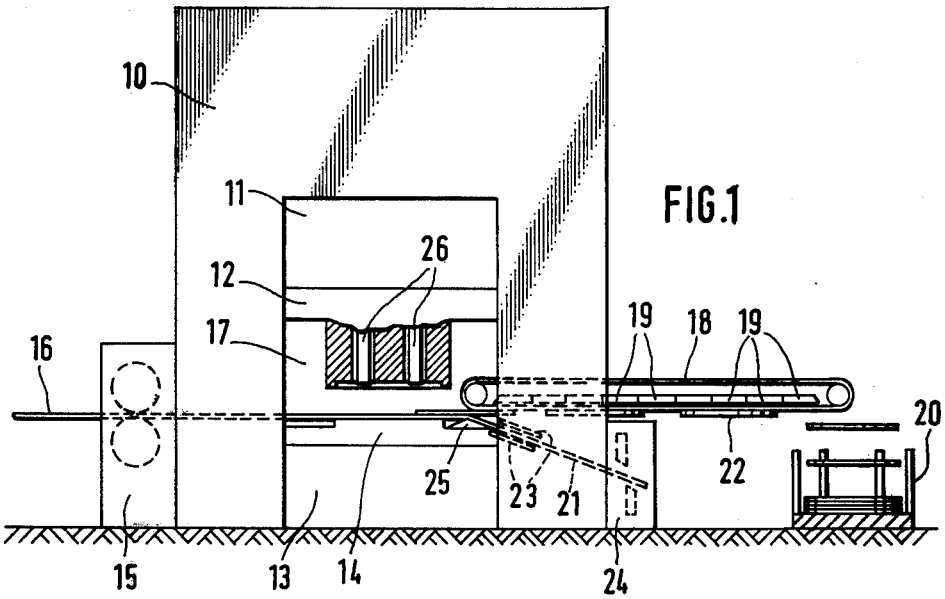
FIG. 1 is a lateral view of a press equipped with the apparatus of the invention, partially in a sectional view.

In FIG. 1, a press 10 is schematically illustrated with a ram 11 and an upper die 12 attached thereto, and with a press table 13 comprising a lower die 14. A roller feed 15 is provided in front of the press 10 as the feeding mechanism. This roller feed is conventionally driven in dependence on the operating cycle and feeds a strip of material 16 from a takeoff reel, not illustrated in detail, through an aligning device into a working area 17 of the press 10. As seen in the conveying direction, a suspended conveyor 18 is fixedly mounted to the press 10 at the end of the operating area 17 above the conveying plane of the strip 16 of material. The attraction power of the suspended conveyor 18 is provided, in the illustrated example by magnets 19 the attraction power of which are controllable.

Figure 2:
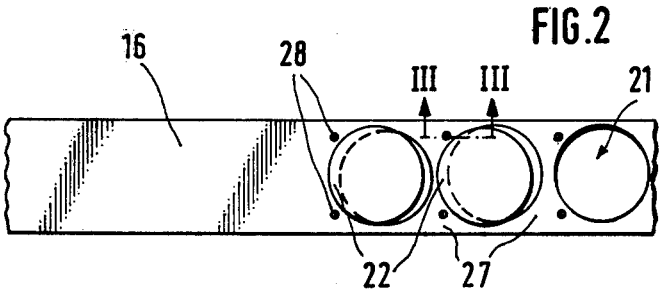
FIG. 2 shows a top view of a fragment of a strip of material, partially as a punched grid with lugs punched therein and with punched-out and ejected components.

A stacking unit 20 is arranged downstream of the suspended conveyor 18, serving for stacking the components 22 punched out from the strip 16 of material with the formation of a punched grid 21 (FIG. 2). In place of the stacking unit 20, constructed with the aid of a mandrel, it is possible to employ a stacking device having a stacking basket fashioned in correspondence with the punched-out components 22. The punched grid 21 resulting after the punching operation is fed to a chopping means 24 at the end of the working area 17 with the aid of guide tracks 23. Instead of providing a chopping means 24, it is also possible to arrange another feeding mechanism, by means of which the punched grid 21 is conveyed to a windup reel for purposes of subsequent processing.

In the conveying plane of the punched grid 21, at the end of the working area 17, a wedge-shaped nose 25 is provided, for example at the lower die 14, which transports the punched out, dropped off components 22, conveyed on the punched grid 21, in the upward direction to the suspended conveyor 18. In the upper die 12, controllable ejectors 26 are provided which are preferably operated hydraulically or pneumatically, and the mode of operation of which will be described in greater detail below.

Figure 3:
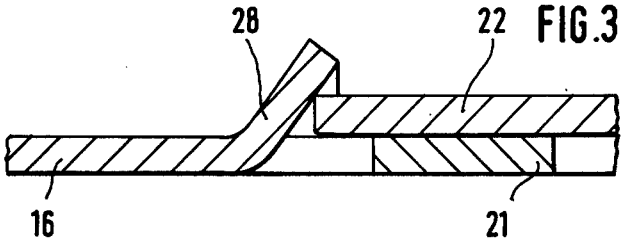
FIG. 3 shows a portion of the strip of material in a sectional view along line III—III of FIG. 2 on an enlarged scale.

During the punching operation, lugs 28 are punched behind the punched-out component 22 into a remaining portion 27 of the strip 16 of material to be processed, as seen in the conveying direction (see FIGS. 2, 3); these lugs 28 serve as entrainment means for the punched-out and dropped-off components 22. The punching of the lugs 28 is accomplished by the upper and lower dies 12, 14 during the punching step wherein the components 22 are manufactured by punching. In this connection, the arrangement of the lugs 28 in the remaining portion 27 of the strip 16 of material as compared with the punched-out and dropped-off components 22 is chosen so that the latter are conveyed to the suspended conveyor 18 in a centered position.

The operating process, which takes place continuously, begins with conveying the strip 16 of material through the roller feed 15 into the working area 17 of the press 10. During this step, the roller feed 15 conveys the strip 16 of material from standstill with increasing acceleration during the return stroke of the ram 11 of the press 10, and with deceleration until standstill, after the ram 11 has traversed its upper dead center. Prior to ram 11 reaching its lower dead center position, the movement of strip 16 of material has halted, and the components 22 are punched out while lower dead center is traversed, while the lugs 28 are punched into the remaining portion 27. Shortly after traversal of the ram 11 to lower dead center, the roller feed mechanism 15 is again accelerated, the controllable ejectors 26 are actuated, and the punched-out component 22 hanging at the upper die 12 is ejected onto the accelerating strip 16 of material. In this connection, the onset of acceleration of the strip 16 of material and the instant of ejection of the punched-out components 22 are adapted to each other so that the punched-out component 22 is dropped from a minimum height onto the already acclerating strip 16 of material, a minor amount in front of the punched-in lugs 28. This step avoids with certainty the drawback that the punched-out component 22 falls back into the punched grid 21, and disturbances arise. This step is accomplished by providing that the onset of conveyance of the strip 16 of material by the roller feed 15 is placed ahead, as compared to the conventional procedure, and the roller feed 15 is started already shortly after the ram 11 has traversed lower dead center.

Since the controllable ejectors 26 drop the punched-out component 22 with a defined force already shortly after traversal of the ram 11 through the lower dead center and must follow the subsequent upward movement of the ram 11 up to upper dead center, hydraulically or pneumatically operable ejectors 26 are advantageously employed, which are provided with reservoir means, not illustrated in detail. Mechanically controllable ejectors, e.g. with spring systems, could not withstand the aforementioned requirments as well as the high stroke rate with which the press 10 operates.

The components 22 (FIG. 2) punched out in accordance with the above description and ejected onto the strip 16 of material comes into centered engagement with the punched lugs 28 (FIG. 3), due to the fact that the strip 16 of material is increasingly accelerated by the roller feed 15; is guided by the wedge-shaped nose 25 to the suspended conveyor 18 during the continued conveyance of the strip 16 of material; and is stacked in a conventional manner in the stacking unit 20. The velocity of the continuously operated suspended conveyor 18 is chosen so that the punched-out and ejected components 22 are with certainty conveyed from the working area 17 of the press 10 at predetermined mutual spacings. During these steps, the punched grid 21 is simultaneously guided in a downwardly inclined direction by the guide tracks 23 to a chopping device 24, by means of which the punched grid 21 is cut into scrap pieces, for example in the operating rhythm of the press 10.

An especially advantageous field of application for an apparatus according to this invention presents itself in the processing of strip material according to precise cutting techniques, for example the punching of electric motor sheet components. A high economy is attained by the high stroke rate attainable —about 100 strokes/minute —as compared to the stroke rates heretofore obtained — about 20–40 strokes/minute.

While we have shown and described one embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. In an apparatus for conveying components punched out from a strip of material with the resulting formation of a punched grid from the working area of a press, wherein a feeding mechanism for conveying the strip of material into the working area of the press is provided, and wherein at least one controllable ejector is arranged in an upper die of said press for ejecting punched-out components onto conveying means during the return stroke of the upper die, the improvement wherein said apparatus further includes means for punching out lugs from said strip of material rearwardly of each punched out component with respect to the direction of travel of said strip of material, and wherein said strip is utilized as said conveying means for said punched out components, with said lugs serving to retain said components on said strip during the travel thereof.

2. The improvement according to claim 1, wherein said lugs are punched out on said strip so as to center the punched out components between the side edges of the strip.

3. The improvement according to claim 2, wherein said apparatus further comprises a fixedly mounted suspended conveyor downstream of the working area of the press and above the conveyance plane of the punched grid.

4. The improvement according to claim 3, wherein said apparatus further comprises a wedge-shaped means, disposed in the conveyance plane of said punched grid and upstream of said suspended conveyor, for guiding punched out components in an upward direction toward the suspended conveyor.

5. The improvement according to claim 1, wherein said apparatus further comprises guide track means, arranged at an end of the working area of the press, for guiding the punched grid in a downwardly inclined direction, and a chopping device, disposed along said track means, for chopping said punched grid into sections.

6. The improvement according to claim 4, wherein said apparatus further comprises guide track means, arranged at an end of the working area of the press, for guiding the punched grid in a downwardly inclined direction, and a chopping device, disposed along said track means, for chopping said punched grid into sections.

7. The improvement according to claim 3, wherein said apparatus further comprises a feeding mechanism, operating in synchronism with said feed mechanism, disposed downstream of the working area of the press.

8. The improvement according to claim 7, wherein said apparatus further comprises a wedge-shaped means, disposed in the conveyance plane of said punched grid and upstream of said suspended conveyor, for guiding punched out components in an upward direction toward the suspended conveyor.

9. The improvement according to claim 8, wherein said apparatus further comprises guide track means, arranged at an end of the working area of the press, for guiding the punched grid in a downwardly inclined direction, and a chopping device, disposed along said track means, for chopping said punched grid into sections.

* * * * *